US012559965B2

(12) United States Patent
Bergman

(10) Patent No.: US 12,559,965 B2
(45) Date of Patent: Feb. 24, 2026

(54) ADJUSTABLE POST ANCHOR WITH AUGER GROUND SUPPORT

(71) Applicant: Richard Bergman, Ottawa (CA)

(72) Inventor: Richard Bergman, Ottawa (CA)

( * ) Notice: Subject to any disclaimer, the term of this patent is extended or adjusted under 35 U.S.C. 154(b) by 251 days.

(21) Appl. No.: 17/737,738

(22) Filed: May 5, 2022

(65) Prior Publication Data

US 2022/0356724 A1 Nov. 10, 2022

Related U.S. Application Data

(60) Provisional application No. 63/184,408, filed on May 5, 2021.

(51) Int. Cl.
*E04H 12/22* (2006.01)
*E02D 5/80* (2006.01)

(52) U.S. Cl.
CPC ..... *E04H 12/2223* (2013.01); *E02D 5/801* (2013.01); *E04H 12/2269* (2013.01)

(58) Field of Classification Search
CPC .. E04H 12/2223; E04H 12/2269; E02D 5/801
See application file for complete search history.

(56) References Cited

U.S. PATENT DOCUMENTS

| | | | | |
|---|---|---|---|---|
| 113,872 | A | 4/1871 | Gill | |
| 380,627 | A | 4/1888 | Nutt | |
| 427,815 | A | 5/1890 | Wolf | |
| 513,115 | A | 1/1894 | Kiler | |
| 1,959,751 | A | 5/1934 | Waldon | |
| 2,227,553 | A | 1/1941 | Paque | |
| 3,011,598 | A | 12/1961 | Galloway et al. | |
| 3,698,144 | A | 10/1972 | Stratton | |
| 3,896,596 | A | 7/1975 | Berger | |
| 4,858,876 | A * | 8/1989 | Moreno | E04H 12/2223 248/548 |
| 4,863,137 | A | 9/1989 | Cockman et al. | |
| 5,076,032 | A | 12/1991 | Lehman | |
| 5,730,555 | A | 3/1998 | Stoner | |
| 9,309,688 | B2 * | 4/2016 | Bergman | E02D 27/42 |
| 9,631,392 | B2 * | 4/2017 | Bergman | E04H 12/2261 |

(Continued)

FOREIGN PATENT DOCUMENTS

| | | | | |
|---|---|---|---|---|
| EP | 2006452 | A1 * | 12/2008 | E02D 5/801 |
| FR | 2863633 | A1 * | 6/2005 | E02D 5/801 |

(Continued)

*Primary Examiner* — Adriana Figueroa

(57) ABSTRACT

A post anchor device comprising an auger rod having a shaft with a lower portion and an upper portion, the upper portion having threads and a terminus configured to being engaged and rotated by a drive tool for rotating the shaft, the lower portion having a bottom end for insertion into the ground and at least one helical blade above the bottom end for boring the auger rod into the ground, at least one fin removably connected to the upper portion and being longitudinally aligned with the shaft, and a post bracket that is securable to the post or beam and having a base with a hole to receive the externally threaded portion of the shaft to enable the post bracket to be removably connected to the external threaded portion by a complementary nut or an internal threaded member, thereby securing the post bracket to the auger rod.

7 Claims, 12 Drawing Sheets

(56) References Cited

U.S. PATENT DOCUMENTS

| | | | | |
|---|---|---|---|---|
| 10,006,185 | B2 * | 6/2018 | Tomchesson | E02D 5/801 |
| 10,774,495 | B2 * | 9/2020 | Oliver | E02D 27/48 |
| 2011/0036025 | A1 * | 2/2011 | Boulay | E02D 5/801 52/165 |
| 2011/0131895 | A1 * | 6/2011 | Dempsey | A63B 63/004 52/157 |
| 2014/0020310 | A1 * | 1/2014 | Lee | E04H 17/009 52/157 |

FOREIGN PATENT DOCUMENTS

| | | | | |
|---|---|---|---|---|
| GB | 2305948 | A * | 4/1997 | E02D 5/801 |
| NL | 9000334 | A * | 9/1991 | E02D 5/801 |
| WO | WO-2012123576 | A1 * | 9/2012 | E02D 5/801 |

* cited by examiner

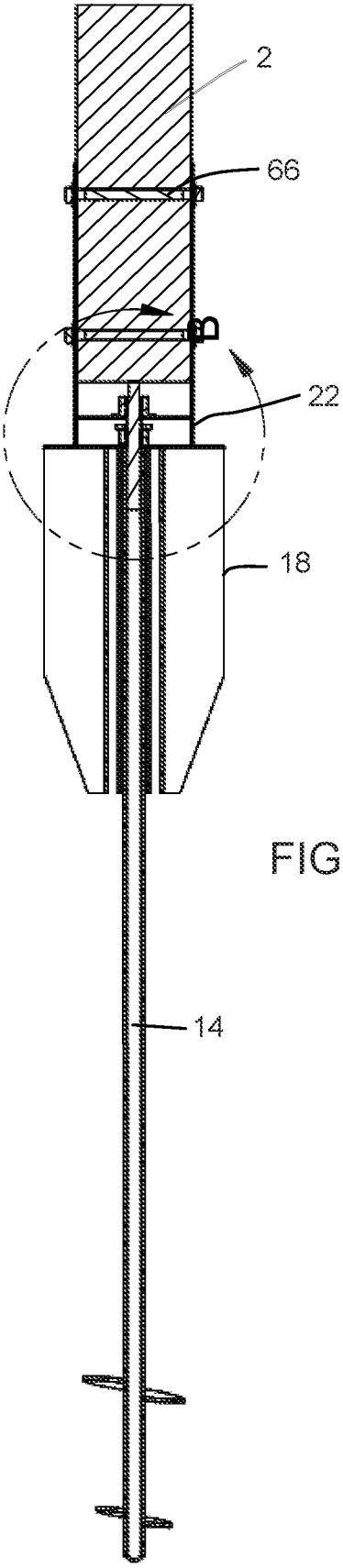
FIG. 17
FIG. 16
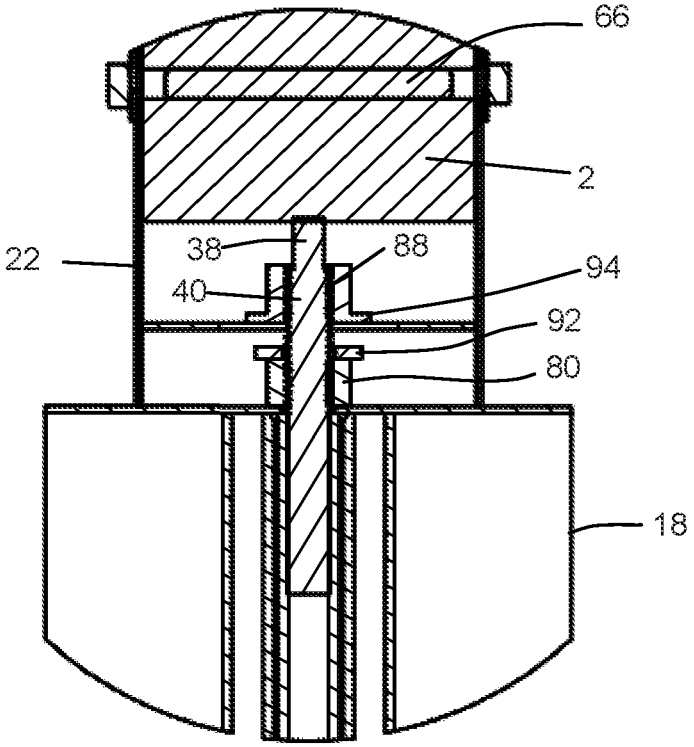
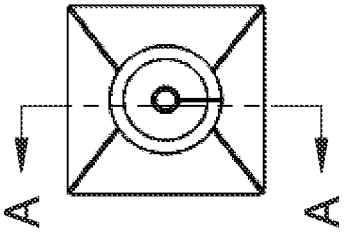
FIG. 15

FIG. 18
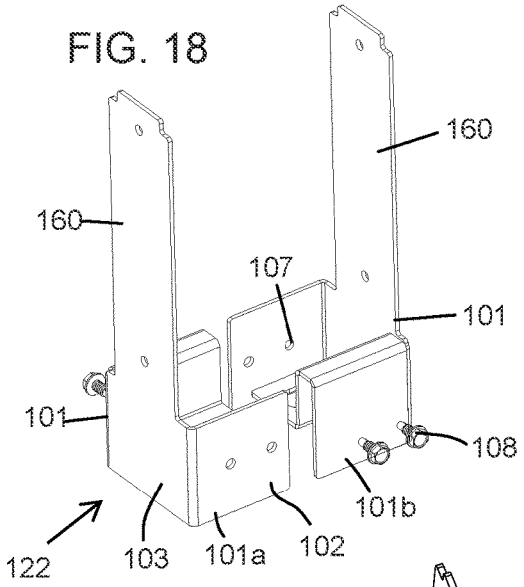
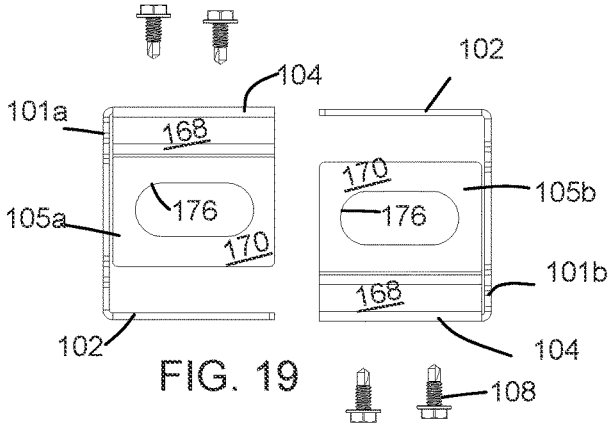
FIG. 19
FIG. 21
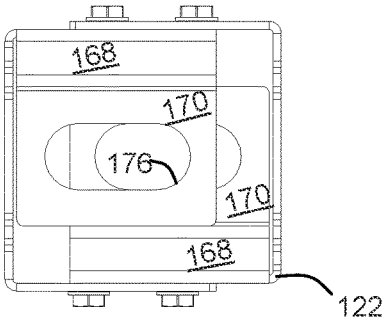
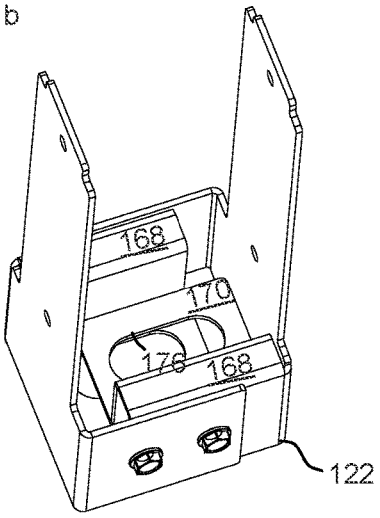
FIG. 20
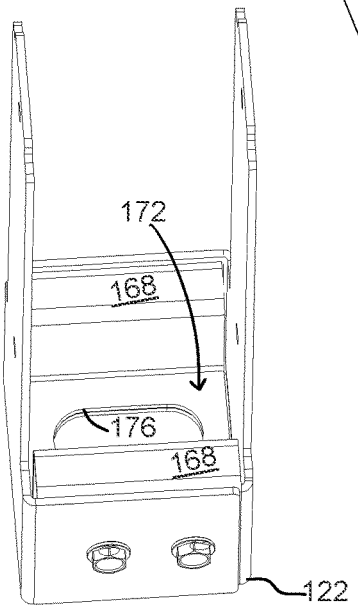
FIG. 22
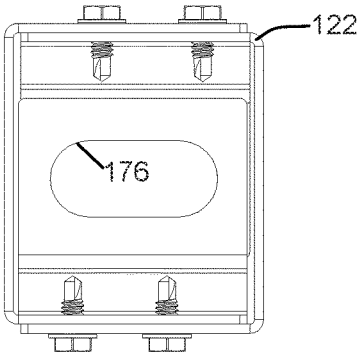
FIG. 23

ADJUSTABLE POST ANCHOR WITH AUGER GROUND SUPPORT

BACKGROUND OF THE INVENTION

1. Field of the Invention

The present invention relates to the assemblies and methods of installing posts into the ground by way of an apparatus that permits horizontal and vertical attitudinal adjustments while providing increased resistance to lateral displacement within the ground.

2. Description of the Related Art

Over the past century and perhaps longer, it has been desirable to install posts into the ground without the need to dig holes and back fill with soil or cement, which requires additional labor and expense. A review of the prior art shows a series of devices such as spikes with integral post brackets and lateral flanges or resistance panels dating back to 1890 and earlier (U.S. Pat. Nos. 427,815, 380,627 and 113,872 by Wolf, Nutt and Gill respectively). The purpose of these style of devices is to permit the apparatus to be impaled with force into the ground, negating the need to dig a hole and for a post to be secured to the upper terminus above the grade.

Lateral resistance panels have evolved to include features that permit the panels to slide together with "T" shaped bars which are impaled into the ground and used to build wire fencing systems (U.S. Pat. Nos. 2,227,553 and 1,959,751).

In 1975, Berger (U.S. Pat. No. 3,896,596) taught how to use a later resistance panel with integrally formed vertically offset apertures that allowed a cylindrical pipe or rod to slide through longitudinally while being impaled into the ground. The panel formed a larger surface area that was positioned in the soil in direction opposition to moment forces generated on it thus hold the smaller diameter pipe firmly in the ground.

This concept was further refined by Lehman (U.S. Pat. No. 5,076,032) for a signpost application and in 1998 by Stoner (U.S. Pat. No. 5,730,555) taught to use a lateral panel with opposing shaped panels.

None of these examples suggest or teach how to use a lateral resistance panel device with the capacity to integrate with a post bracket mechanism that can permit horizontal adjustments which are very helpful during the installation of numerous fence posts to form a straight line, or the ability to easily adjust posts vertically plumb.

At the same time many helically anchored devices have been developed. They avoid impalement methods of installation and rely on rotational forces. Some of these include integral post bracket or attachment means at the upper terminus of the post. The Kiler device (U.S. Pat. No. 513,115) from 1894 is the first iteration of this hybrid style. But variants of the Kiler device are seen in other devices (U.S. Pat. No. 3,698,144 Stratton and U.S. Pat. No. 4,863,137 Cockman). The Stratton apparatus includes a helical blade auger with a post bracket and a locking key pin to allow posts that may be damaged by snowplows to be easily replaced. The Cockman device introduced a compression disc integrally connected to the shaft of a helical auger. It also employed a simple post bracket at the upper terminus.

Galloway (U.S. Pat. No. 3,011,589) taught the use of a helical auger that worked together with a fin shaped tubular device resembling the fletching of an arrow. Galloway's tri fin device was impaled into the ground over top and longitudinally along the auger tube once the auger reached its final depth in the soil. The fletching served to provide lateral stability of the anchor once in the ground. A round metal post could then be fit over top the upper cylindrical terminus of the auger tube and a bolt could be inserted transversely through the post and the auger tube securing them together.

However, the fletching device must be installed with hammer strikes to the individual fins which being thin metal, are vulnerable to deformation. There is also no means to horizontally adjust the position of the auger to line up with the center line of a fence system. Nor is there any means to plumb the post vertically as it is mated and secured with the upper terminus of the auger.

Another apparatus developed by Pylex™ is a further variation of a helical auger with either a single or multi-fin fletching feature welded to the auger shaft. Since the fletching is welded to the auger, a hole at least as deep as the fletching must be dug in advance of the auger being placed into the hole and then screwed into the ground. On a 48" auger with fins that descend almost half its total length, a hole nearing 24" must be dug before the auger can be placed inside it. When the auger has been screwed to the desired depth, soil must be back filled into the void around the fins or fletching to stabilize the auger.

This system has several disadvantages from a helical only or spike device. Firstly, the installation requires both digging and screwing. Secondly, the digging of a hole creates a need for backfill material which being disturbed soil requires packing, tamping, moisture and time in order to begin to coalesce and mimic undisturbed soil.

The Pylex device is also not designed to permit simple horizontal adjustments to finalize the post location. This is problematic when trying to align a plurality of posts along a central line such as a fence application or the like.

To summarize, there are numerous disadvantages of all these style of post anchoring devices. Those which rely upon helical blades and rotational force for installation require sub-terranean lateral displacement or resistance panels to prevent the small diameter auger tube from moving within the soil while under the force of moment loads to the post attached to it.

Fletching devices incorporated with a helical auger can restrict lateral motion while under load but there is no means to adjust for an improperly located auger that may fall out of line with a plurality (three or more) of posts. Furthermore, there is no means to adjust the post vertically to achieve plumb.

The style of devices that employ spikes and require impalement forces for installation can integrate with sub-terranean lateral displacement or resistance panels but also have no simple means of adjusting horizontally or vertically as required when a post is installed. These weaknesses render all the prior art lacking with respect to some of the most desired qualities by those who wish to build structures such as fences, arbors, pergolas, gazebos and the like which have significant lateral resistance requirements.

An ideal solution should consider an installation method that is less laborious than impalement methods such as spikes. Although there are spike style post anchors which embody a universal style joint between the post bracket and the spike, they only permit vertical adjustments to bring a post into a position of plumb. They do not permit horizontal adjustment to bring a post back into alignment with a plurality of posts forming a fence.

The ideal solution would employ the ease of an auger mechanism that ideally could be installed with a common handheld impact wrench, either pneumatic, corded or cordless if sufficient torque can be generated. Most importantly the auger system should employ a single or multi-fin fletching component that can provide lateral resistance from any direction and is integrated with the auger in such a way that digging a hole to conceal the fletching is not required. An improved solution would ensure that if the fletching is to be struck with force to impale it into the upper 12"-16" of soil, the blades of the fletching can be protected from damage during such striking. The ideal solution would integrate a post bracket or saddle than can connect with the upper terminus of the auger and adjusts horizontally in order to be aligned precisely along a common line formed from a plurality of posts. Finally, such an ideal solution would be easy to adjust posts vertically plumb inside the post saddle and secured with sufficient strength as to be comparable to a fence post set into concrete.

These attributes combined into a single device would make setting posts into the ground less laborious, faster, less expensive and permit precise horizontal and vertical adjustments that other means presently available to consumers do not.

Accordingly, there is a need for a device which can improve the means of installing posts into the ground; can provide improved lateral resistance and easily adjust horizontally and vertically for structures like fences, arbors, pergolas, gazebos and the like.

SUMMARY OF THE INVENTION

An embodiment of the invention comprises an auger, a multiple fin device with integral cap plate and a post receiving bracket. In this embodiment the auger, fin device and post bracket are separate pieces which assemble during installation to create the invented device from which the stated benefits and heretofore unavailable advantages are derived.

In an embodiment, the post anchor comprises of an auger with at least one helical blade at the lower terminus. The fin cap plate device forms a longitudinal channel which the auger shaft passes though. There is also an aperture in the center of the cap plate through which the drive rod of the auger passes through. At the upper terminus, the drive rod has a hex shaped head to be received in a socket, a threaded portion below the hex head protrudes outwards vertically along the extended longitudinal axis of the rod such that the cap plate may rest upon the shoulder of the auger tube which is of greater diameter than the diameter of the threaded drive rod. The fin device is secured to the auger by a nut threaded along the auger threads. The post bracket is placed over the protruding drive rod of the auger. The drive rod passes through an elongated aperture formed in the lower channel of the post bracket. The post bracket is free to slide laterally to the extent that the drive rod may move within the confines of the elongated aperture. The post bracket is finally secured against the cap plate by a washer and nut screwed down along the threaded portion of the auger drive rod. All three component parts are now secured as one complete post anchoring device.

In an embodiment, the post bracket has at least two vertical upstanding flanges whose inner surfaces are opposite each other and allow a post to fit between. The flanges have defined in them various holes for fasteners, two pairs of said holes located in mirror opposite position on opposing flanges such that a continuous fastener or ideally a barrel bolt or coupling nut with screws can pass and provide maximum security when a post is connected therein.

In some aspects, the present invention provides a post anchor device for anchoring an end of a support post or beam of a deck or similar construction to the ground, the post anchor device comprising: an auger rod having a shaft with a lower portion and an upper portion, the upper portion having an externally threaded portion and terminating in an upper end configured to being engaged and rotated by a drive tool for rotating the shaft about its longitudinal axis, the lower portion having a bottom end for insertion into the ground and at least one helical blade on the shaft above the bottom end for boring the auger rod into the ground as the shaft is rotated about the longitudinal axis; at least one fin removably connected to the upper portion and being longitudinally aligned with the shaft of the auger rod; and a post bracket that is securable to the post or beam and having a base with a hole to receive the externally threaded portion of the shaft to enable the post bracket to be removably connected to the external threaded portion by a complementary nut or an internal threaded member, thereby securing the post bracket to the auger rod.

In some embodiments, the at least one fin may include a tubular portion that is receivable onto the upper portion of the shaft to removably connect the at least one fin to the auger rod.

In some embodiments, the at least one fin may comprise a plurality of fins radiating from the tubular portion.

In some embodiments, the at least one fin may further comprise a cap plate perpendicular to the tubular portion to provide a platform to support the post bracket.

In some embodiments, the post bracket may include a base that defines a hole that receives the externally threaded portion of the shaft.

In some embodiments, the hole in the base may be an elongate aperture to enable lateral positioning of the threaded portion within the elongate aperture thereby permitting adjustment of the post bracket relative to the fin assembly prior to tightening of the complementary nut or an internal threaded member.

In some embodiments, the cap plate may include at least one elongate slot, the base of the post bracket may include at least one secondary hole that may be placed in vertical alignment with the at least one slot with the post bracket positioned on the cap plate, and a secondary threaded fastener that may be passed through the slot and the aligned secondary opening to provide additional securing force between the post bracket and the fin assembly thereby increasing the resistance to lateral movement of the post bracket relative to the fin assembly.

In some embodiments, the post bracket may further comprise a support portion defining a support surface for abutting the post or beam, the support surface being located vertically on the receiving bracket to be above the upper end of the shaft with the external threaded portion received in the post bracket, at least two vertical planar walls extending above the support surface to receive fasteners to secure the walls to the post or beam.

In some aspects, the present invention provides a post anchor device comprising an auger rod, a fin assembly removably mountable onto the auger rod, and post bracket removably mountable onto the fin assembly.

In some aspects, the present invention provides a post anchor device comprising an auger rod, at least one fin removably connectable to the auger rod, and post bracket removably connectable to the auger rod.

In some embodiments, the auger rod may comprise a shaft with a lower portion and an upper portion terminating in an upper end configured to being engaged and rotated by a drive tool for rotating the shaft about its longitudinal axis, the lower portion having a bottom end for insertion into the ground and at least one helical blade on the shaft above the bottom end for boring the auger rod into the ground as the shaft is rotated about the longitudinal axis; the at least one fin is removably connected to the upper portion and being longitudinally aligned with the shaft of the auger rod; and the post bracket that is securable to the post or beam and having a base removably connectable to the upper portion of the auger rod.

In order to properly install the invention and gain the benefit of the functional features of the device, the at least three described independent devices would be installed together along a straight line with at least two other independent post anchor devices such that post brackets can be very accurately and laterally adjusted to bring all the post brackets into common alignment. Furthermore, the posts can be vertically plumbed within the post bracket and then secured in final position.

BRIEF DESCRIPTION OF THE DRAWINGS

For a better understanding of the present invention and to show more clearly how it may be carried into effect, reference is made by way of example to the accompanying drawings in which:

FIG. 15 is a top plan view of the embodiment shown in FIG. 1;

FIG. 16 is a longitudinal section along line A-A shown in FIG. 15 inclusive of a post;

FIG. 17 is a close-up of area B shown in FIG. 16;

FIG. 18 is an exploded perspective view of a modified embodiment of an adjustable size post bracket shown in FIG. 3; and FIG. 19 is a top view of the embodiment of the separated mating parts shown in FIG. 18;

FIG. 20 is a perspective view of the embodiment of the mating parts shown in FIG. 18 which depicts the manner in which the overlapping parts maximize the post size capacity while minimizing the opening of the elongated aperture for the passage of the drive head of the auger;

FIG. 21 is a top view of the embodiment of the separated mating parts shown in FIG. 18 which depicts the manner in which the overlapping parts accommodate larger posts;

FIG. 22 is a perspective view of the embodiment of the mating parts shown in FIG. 18 which depicts the manner in which the overlapping parts minimize the post size capacity while maximizing the opening of the elongated aperture for the passage of the drive head of the auger;

FIG. 23 is a top view of the embodiment of the parts shown in FIG. 22;

DETAILED DESCRIPTION

Figure 1:
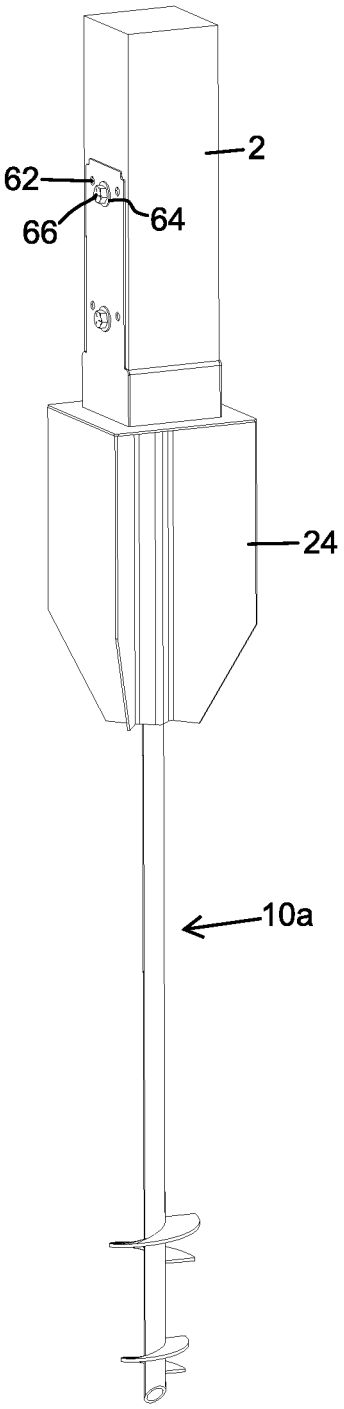
FIG. 1 is a perspective side view of an embodiment of a post anchor device of the present invention shown in an operable configuration with a post secured thereto.

For the purposes of promoting an understanding of the principles of the invention reference will now be made to the exemplary embodiment illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one, skilled in the relevant art and having possession of this disclosure, are to be considered within the scope of the invention.

Figure 2:
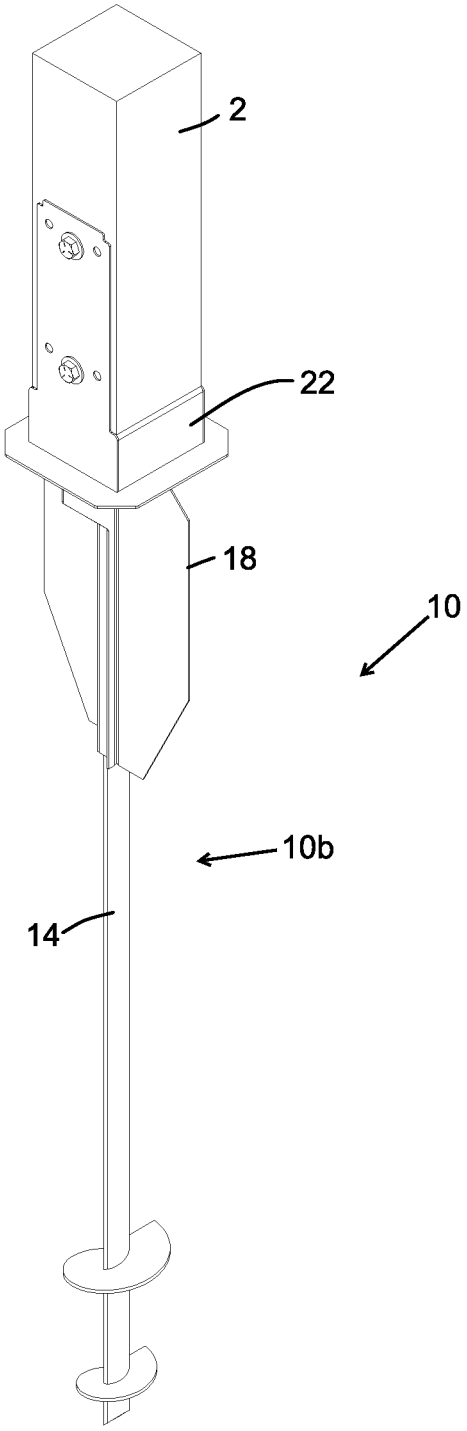
FIG. 2 is a perspective side view of another embodiment of a post anchor device of the present invention shown in operable configuration with a post secured thereto.
Figure 3:
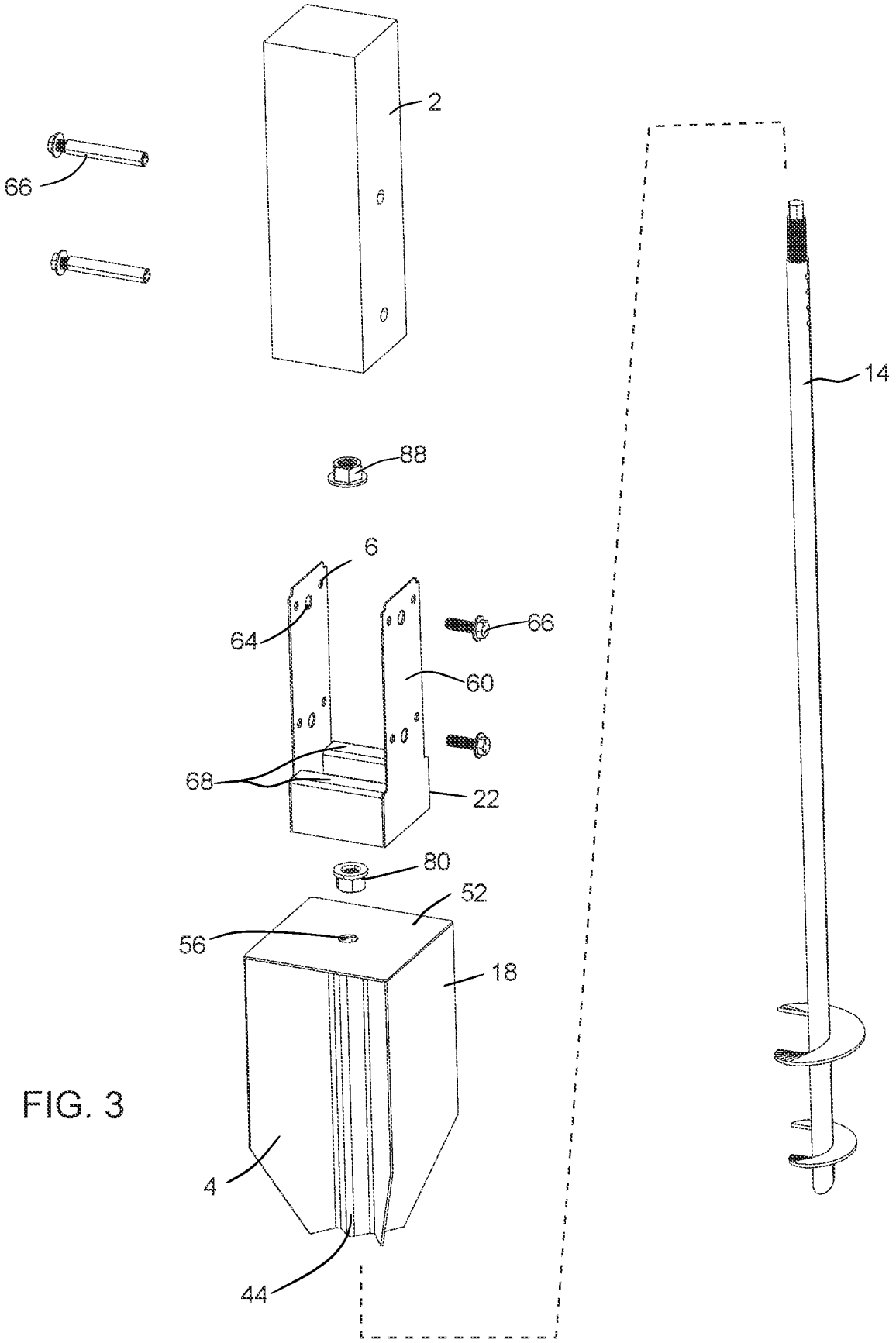
FIG. 3 is an exploded perspective view of the embodiment of FIG. 1.

Referring to FIGS. 1-3, there are shown two variants of a post anchor device 10, namely, post anchor device 10*a* and post anchor device 10*b*, both shown with a bottom portion of a post 2 fastened thereto. Post anchor device 10 comprises auger rod 14, fin assembly 18, and post bracket 22. Post anchor device 10*a* and post anchor device 10*b* are identical except in the number of fins 24 on fin assembly 18: post anchor device 10*a* has a fin assembly 18 having four fins 24, whereas post anchor device 10*b* has a fin assembly 18 having two fins 24.

Referring to FIGS. 4-7 and 14, the auger rod 14 comprises a rigid rod or tubular shaft 16 having a bottom end 28, preferably having a sharp edge or spike portion 30 to facilitate the bottom end 28 being driven into the ground, and an opposite top end 34. The shaft 16 of the auger rod 14 may be of varying length depending on the soil conditions. Near the bottom end 28 are provided one or more helical blades 32 that enable the auger rod 14 to be driven into the ground by the application of a rotational force that cause the helical blades 32 to bite into the adjacent material, propelling the auger rod 14 deeper into the ground. The helical blades 32 also function to retain the auger rod 14 in the ground as they resist the auger rod 14 from being pulled out by an application of force other than a rotational force in a counter-direction. The top end 34 includes a threaded portion 36 and a terminus 38 that accommodates a complementary socket or wrench for use in imparting rotational force to the auger rod 14 to drive it into the ground. The terminus 38 in the illustrated embodiment is hexagonal, which is a shape that accommodates common socket tools and wrenches, but the terminus 38 may be square, triangular, or otherwise shaped provided such shape can accommodate a complementary tool for rotationally driving the auger rod 14 so that the helical blades 32 bite progressively deeper into the ground. In the case where the shaft 16 is a solid rod, the threaded portion 36 and the terminus 38 may be machined into the solid rod. However, for reduced weight and material, it may be preferable that the shaft 16 is tubular, in which case a separate solid drive rod 40, on which the threaded portion 36 and terminus 38 are machined or cast, may be welded into the upper end of the shaft 16. Accordingly, such drive rod 40 has a lower portion extending into the hollow auger shaft 16 and is welded securely in place in a manner to sustain high torque loads that the shaft 16 sustains during installation. In the illustrated embodiments, the welds are applied through holes 35 cut into the side of the shaft 16.

Figure 4:
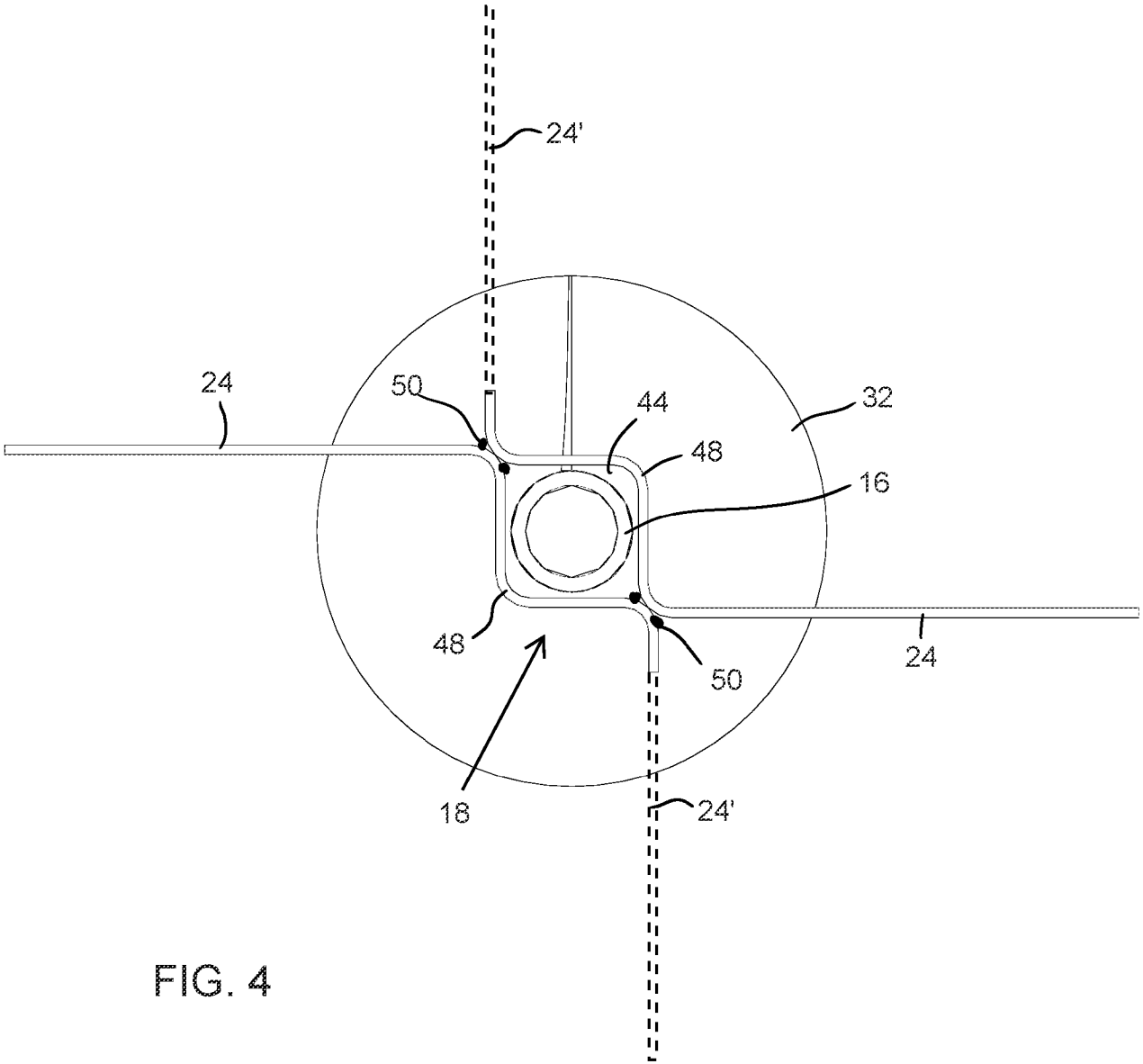
FIG. 4 is a cross-section of a fin assembly of the embodiment shown in FIG. 2, and of the fin assembly of the embodiment shown in FIG. 1 when taking into consideration the fins shown in broken lines.
Figure 6:
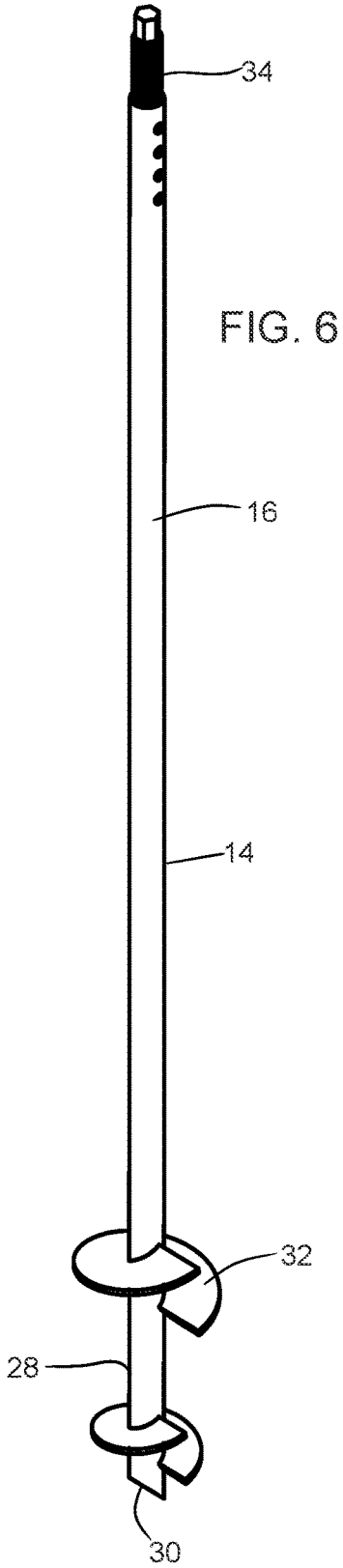
FIG. 6 is a side perspective view of the auger rod of the embodiments shown in either FIG. 1 or 2.
Figure 5:
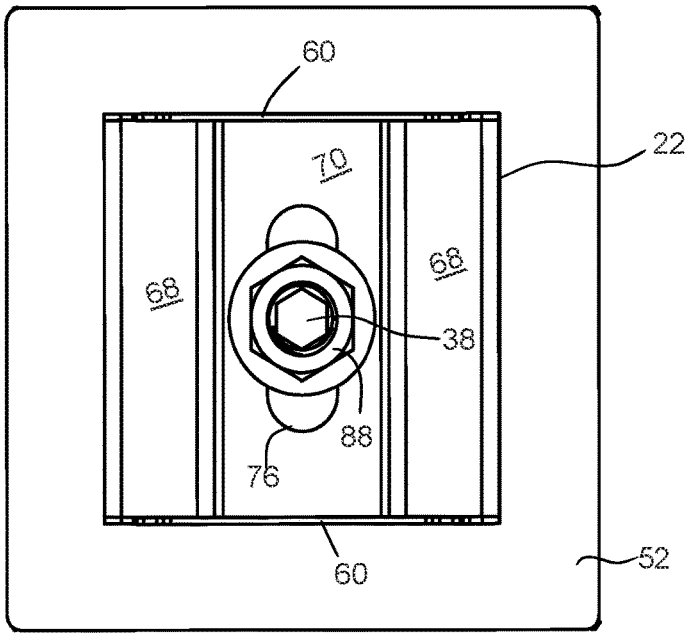
FIG. 5 is a top plan view of embodiment shown in FIG. 1.

Referring to FIGS. 3-5, the fin assembly 18 comprises a central tubular portion 44 that is adapted to fit around an upper portion of the auger rod 14. The fins 24 radiate outwardly from the central tubular portion 44. The leading edge 102 each fin 24 is sloped outward from a point 99 adjacent the shaft 16 of the auger rod 14 to facilitate the fins 24 to pierce into the soil during installation of the fin assembly onto the auger rod 14 as further described below.

In the illustrated embodiment, the fin assembly 18 comprises two identically formed fin panels 48 which are welded together at welds 50 to create what appears to be two conjoined "W" shapes when viewed from above that define the central tubular portion 44 through with the auger shaft 16 passes. The central tubular portion 44 could also be semicircular so long as it is not less than the diameter of the shaft 16 of the auger rod 14.

This fin assembly constructed in this manner can also be modified by omitting two parallel fins 24 to result in the two-finned fin assembly 18 in post anchor device 10*b*. Such post anchor is well suited for a fence application where resistance to lateral force against the vertical plane of the fence is required. And this saves material where the additional pair of fins is not required. Furthermore, in this two-fin embodiment, the fin assembly 18 may be oriented approximately 90 degrees such that the pair of fins is in direct perpendicular opposition to the lateral forces that would be placed against the fence in the field.

A cap plate 52 is formed or welded to the top edges of the two fins 24 to provide a platform for the post bracket 22. A hole 56 is provided in the center of the cap plate 52 to accommodate the threaded portion 36 and the terminus 38 of the auger rod 14. The cap plate 52 may be modified if desired as shown in some of the figures (for example FIG. 2) in which the corners are cut at 45 degrees to remove excess material. The fins 24 in the illustrated embodiment are arranged to coincide with the corners of the cap plate 52.

Figure 7:
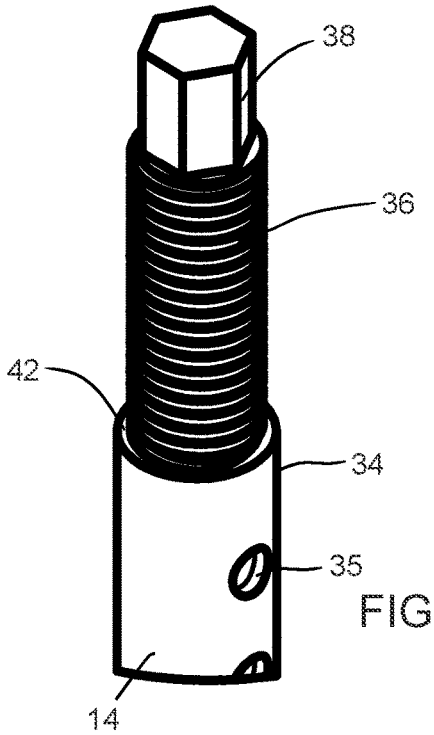
FIG. 7 is a close-up of the upper part of the auger rod shown in FIG. 6.

Referring to FIG. 7, a circumferential flat shoulder 42 is provided at the intersection of the upper end of the body 16 and the threaded portion 36 permitting the cap plate 52 to seat securely against the shaft 16.

Referring to FIG. 10-14, 16,17 there is shown an embodiment of a post bracket 22 comprising two opposing and upwardly standing walls or panels 60 rising from a first horizontal planar surface 68 upon which the bottom end of post 2 rests, and a second planar surface 70 parallel to the first surface 68 but lower such that a cavity 72 is defined when the post 2 is fully seated on the first surface 68. The cavity 72 accommodates the terminus 38 of the auger rod 14 in the fully assembled post anchor device 10 so that it does not interfere with the seating of the post 2 into the post bracket 22. The opposing vertical side panels 60 include a plurality of holes 62 to receive fasteners for securing the panels to the post, and at least two pair of holes 64 in mirror opposition and sized to one another such that a continuous fastener such as a barrel bolt or coupling nut 66 may pass through said holes 64 and through the post 2 to secure the post bracket panels 60 to the post 2. The cavity 72 has its lower limits defined by the lower planar surface 70 which is more easily depicted in FIG. 14.

An elongate aperture 76 in the surface 70 is adapted to receive the threaded portion 36 of the auger rod 14 and provides some travel of the threaded portion therein. The travel of the threaded portion 36 within the elongate aperture 76 enables a degree of movement of the post bracket 22 relative the auger rod 14 (which is secured to the soil in use of the device) to accommodate imperfect linear alignment of a plurality of post anchoring support devices by enabling each post bracket 22 to be moved laterally in relation to the linear direction of an intended common post or fence line.

In other embodiments, the post bracket may be adapted to accommodate round posts and secure them to the auger rod 14. For example, the panels 60 may be two ⅓ segments of a diameter matching a round post or tube.

Figure 11:
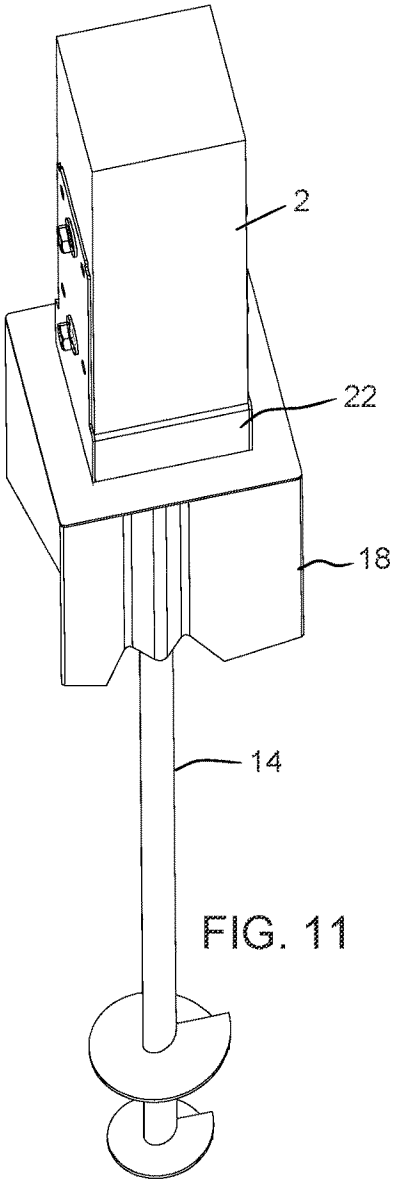
FIG. 11 is a perspective view of the embodiment shown in FIG. 10 with a post mounted in the post bracket.
Figure 10:
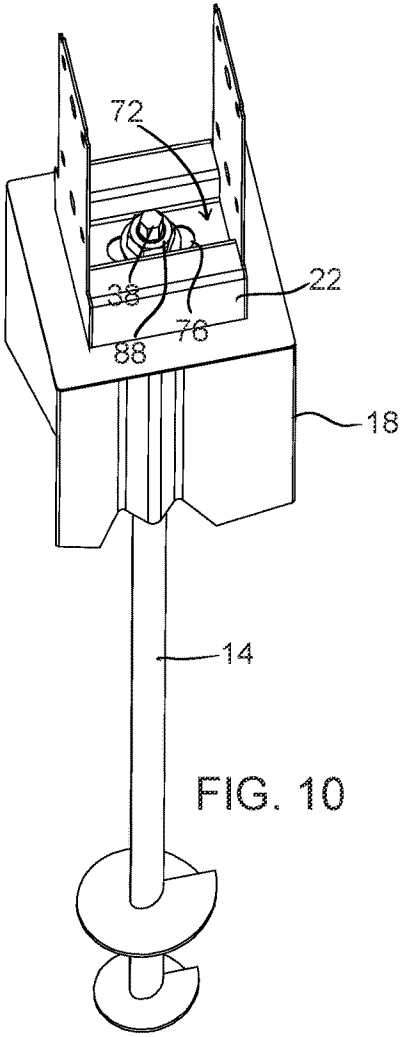
FIG. 10 is a perspective view of the post bracket mounted on the fin assembly, which is mounted on the auger rod of the embodiment shown in FIG. 1.
Figure 9:
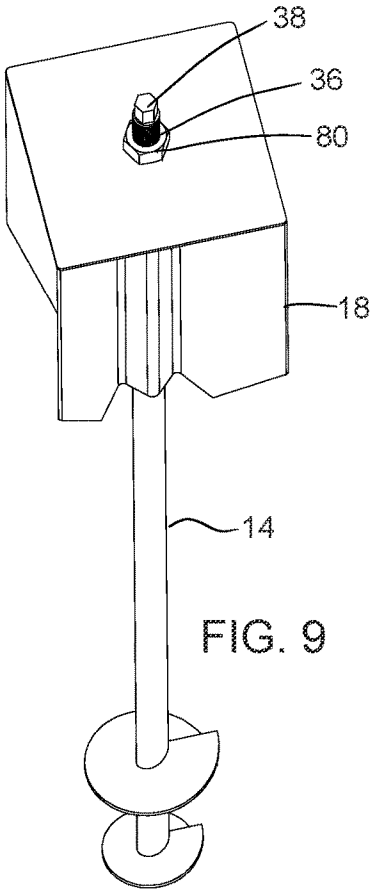
FIG. 9 is a perspective view of the fin assembly mounted on the auger rod of the embodiment shown in FIG. 1.
Figure 8:
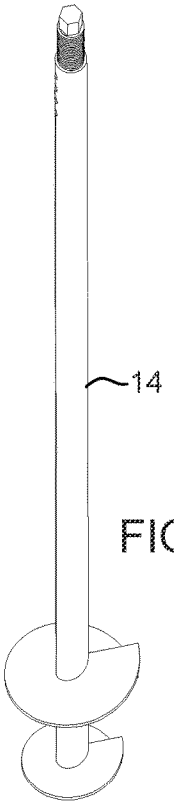
FIG. 8 is a perspective view of the auger rod of the embodiment shown in FIG. 1.
Figure 13:
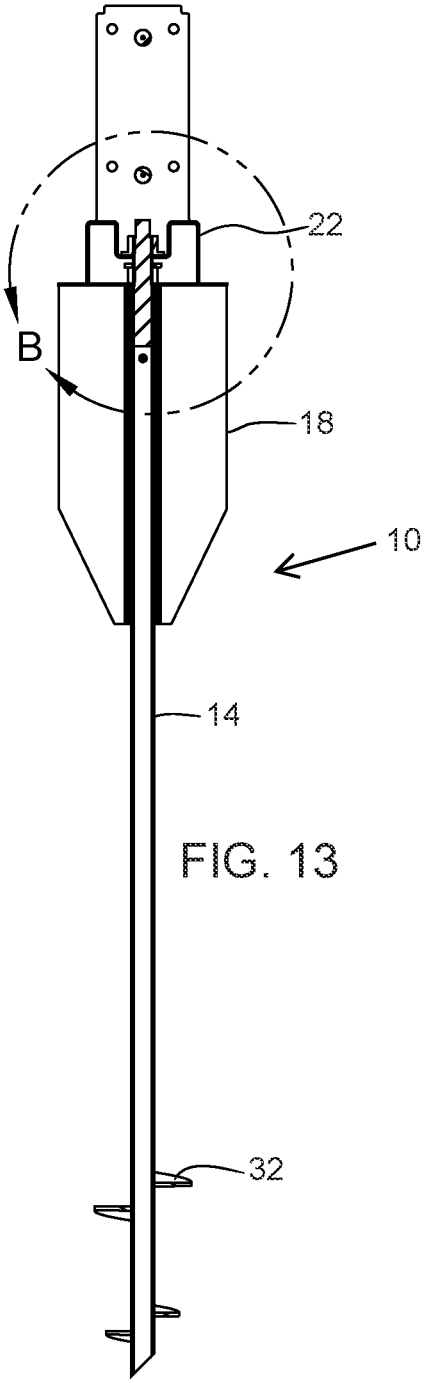
FIG. 13 is a longitudinal section along line A-A shown in FIG. 12.
Figure 12:
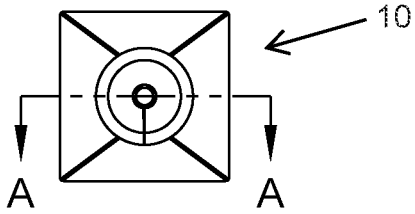
FIG. 12 is a bottom plan view of the embodiment shown in FIG. 1.
Figure 14:
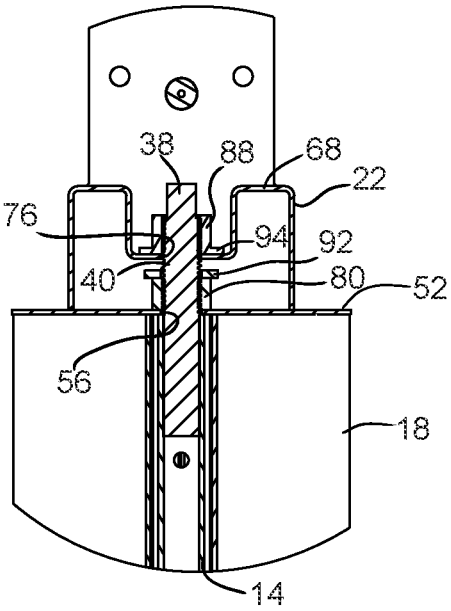
FIG. 14 is a close-up of area B shown in FIG. 13.
Figure 24:
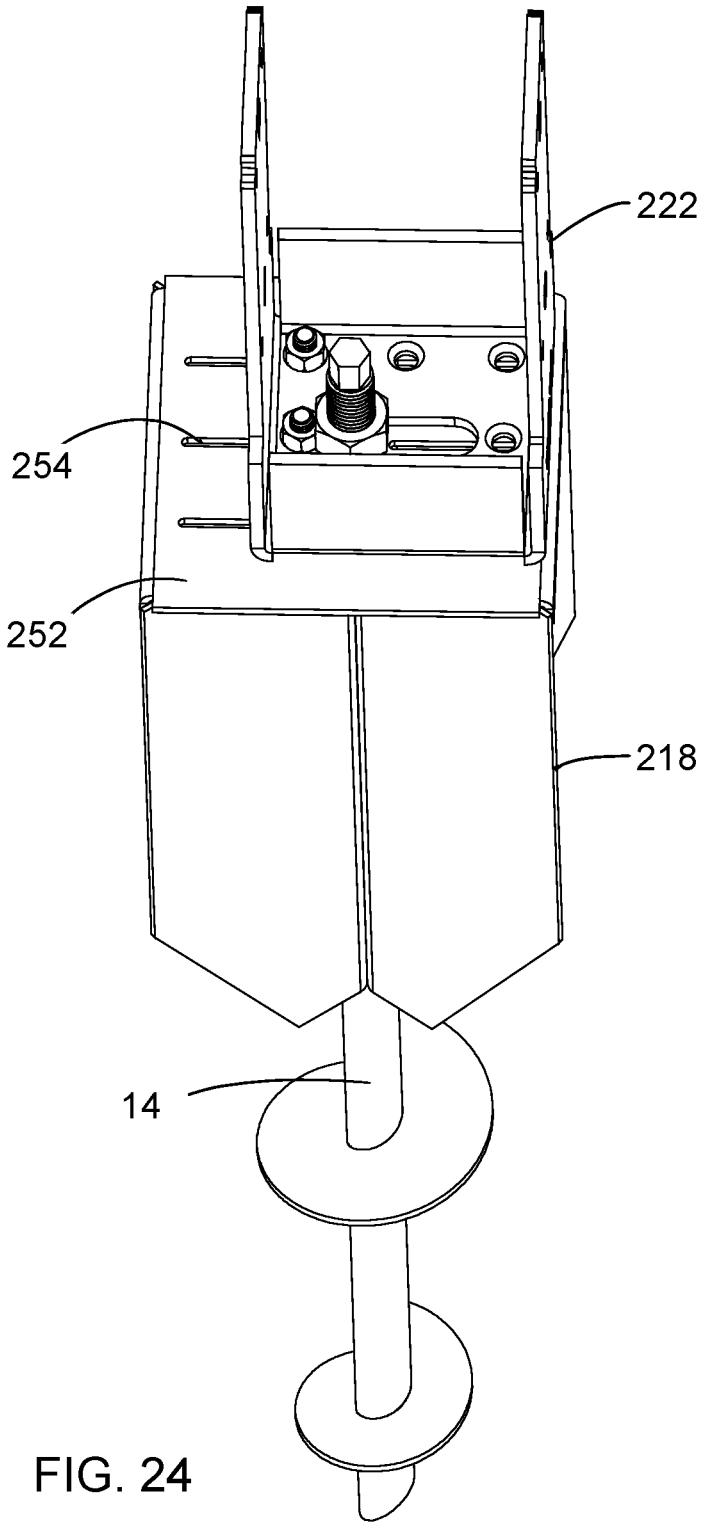
FIG. 24 is a perspective view of another embodiment of a post anchor device of the present invention.
Figure 25:
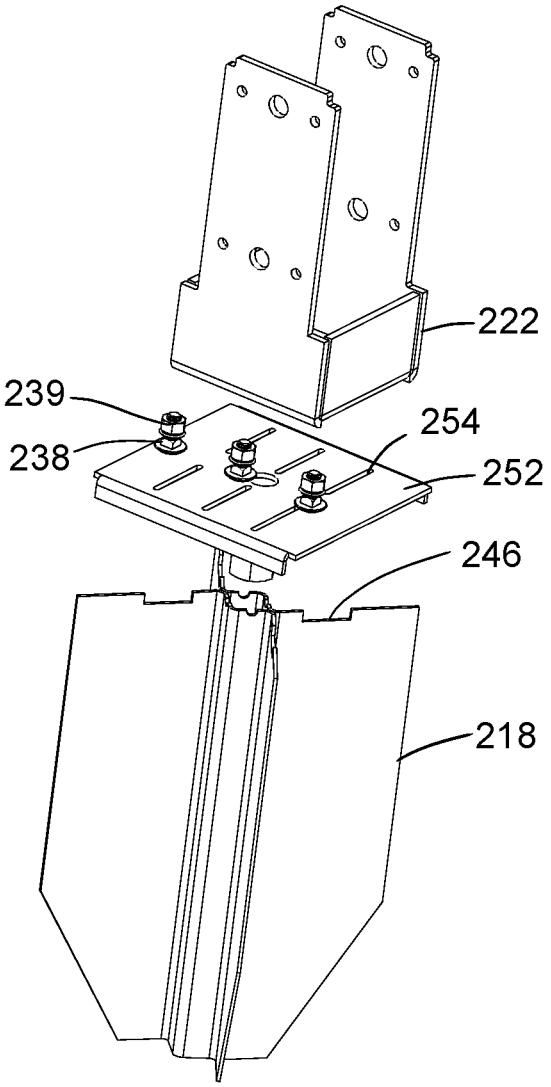
FIG. 25 is a perspective exploded view of the fin assembly and post bracket of the embodiment of FIG. 24.
Figure 26:
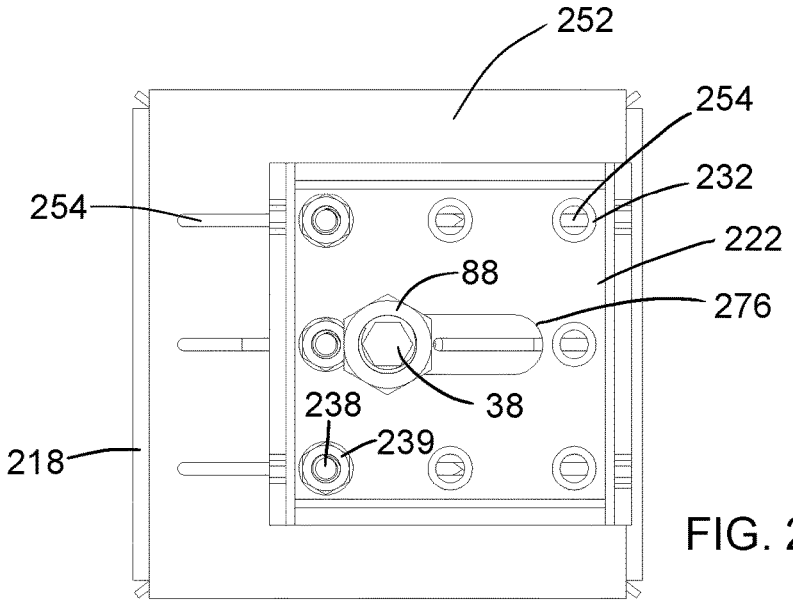
FIG. 26 is a top plan view of the fin assembly and post bracket of the embodiment of FIG. 24.
Figure 27:
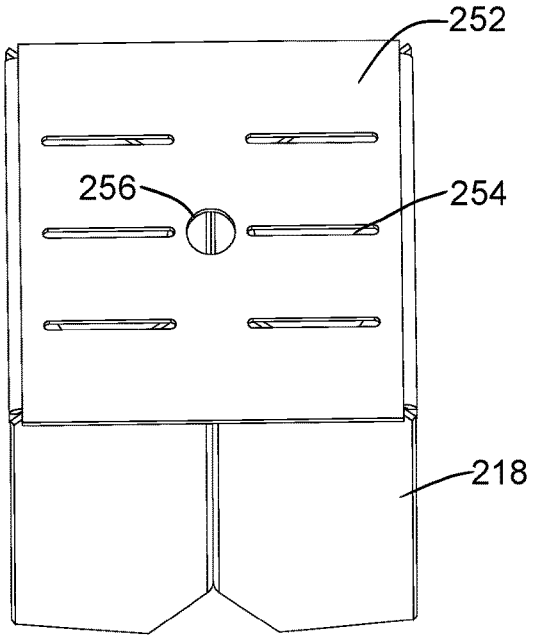
FIG. 27 is a perspective view of the fin assembly of the embodiment of FIG. 24.
Figure 28:
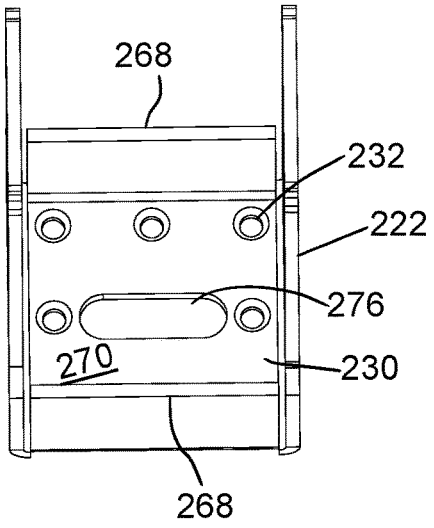
FIG. 28 is a perspective view of the post bracket of the embodiment of FIG. 24.
Figure 29:
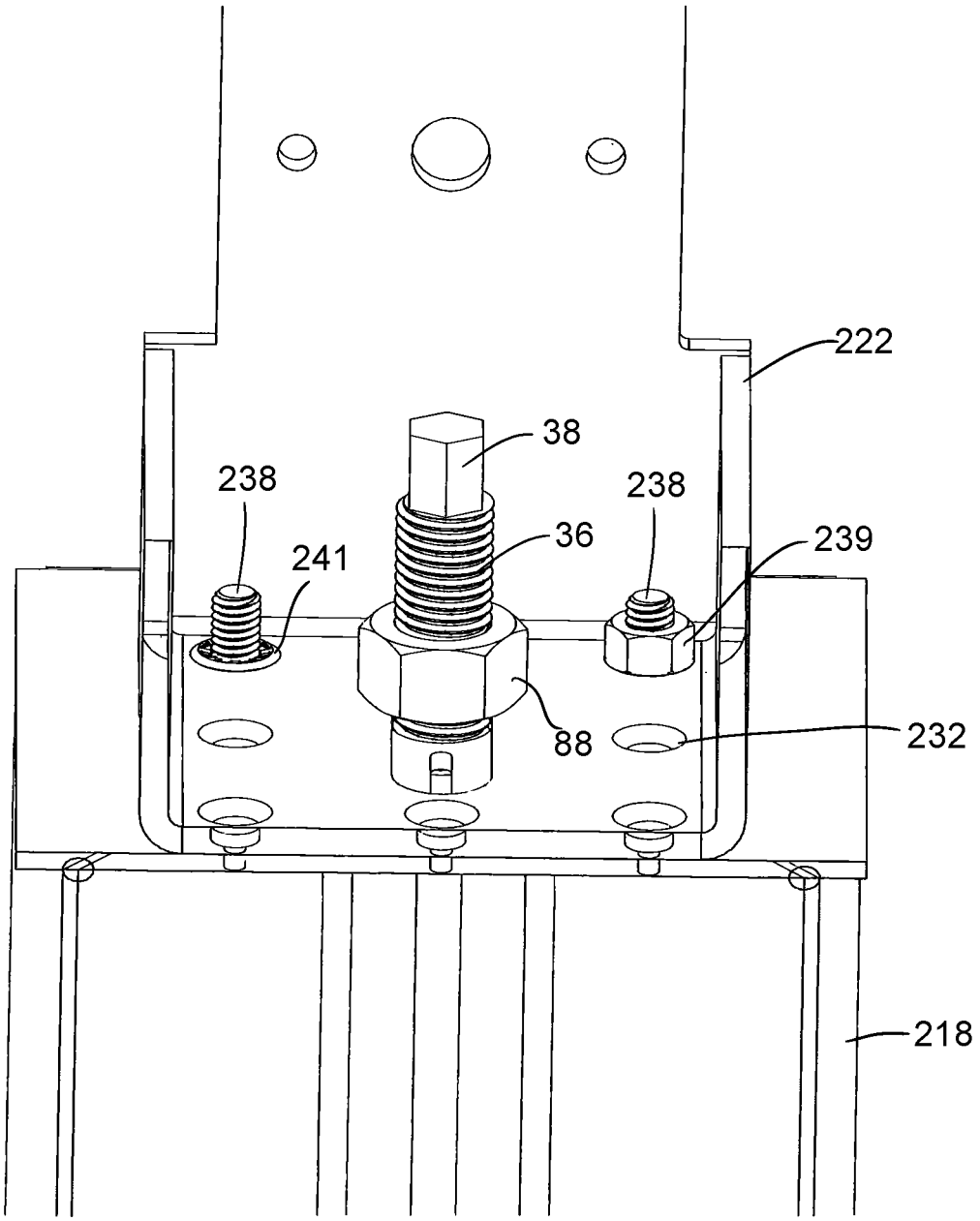
FIG. 29 is a partial section view of the fin assembly, post bracket and the auger rod of the embodiment of FIG. 24.

Referring to FIG. 8-11 the post anchor device 10 is shown in a sequence of assembly beginning with the auger rod 14 shown on its own in FIG. 8. In FIG. 9 the fin assembly 18 is shown bolted onto the threaded portion 36 of the auger rod 14 with the terminus 38 extending above the cap plate 52. In FIG. 10 the post bracket 22 is shown bolted onto the cap plate 52 of the fin assembly 18 with the threaded portion 36 being received within the elongate aperture 76 and the terminus 38 being within the cavity 72 so that it does not protrude above the plane of the surface 68. In FIG. 11 a post 2 is shown mounted within the post bracket 22, being secured to the panels 60 by the barrel bolt or coupling nut 66 and with the post end resting on the planar surface 68.

Referring to FIGS. 12-17, the assembled post anchor device 10 with a post 2 attached is shown in longitudinal section. The fin assembly 18 is secured to the auger rod 14 by a nut 80 and washer 92. In particular, the circular aperture 56 defined centrally on the cap plate 52 of the fin assembly 18 permits the drive rod or threaded portion 40 of the auger to pass through cap plate 52 but movement of it downward on the auger rod 14 is stopped by the larger diameter of the auger shaft 14 and thus the cap plate 52 of the fin assembly 18 rests upon the circumferential shoulder 42.

The post bracket 22 rests upon the cap plate 52 is secured to the auger rod 14 by nut 88 and washer 94. In particular, the elongate aperture 76 (FIG. 5) fits around the threaded portion 40 of the auger rod 14 and the post bracket 22 rests upon the cap plate 52 of the fin assembly 18. Nut 88 and washer 94 are used to tighten and secure the post bracket 22 onto the auger rod 14 and against the cap plate 52 fin assembly 18. The top portion of auger rod 14 and nut 88 fit within the cavity 72 defined in the post bracket 22 to provide clearance for the bottom of the post 2 to rest upon the planar surface 68.

Accordingly, the threaded portion 40 of the auger rod 14 is received through the elongated aperture 76 defined in the lower planar surface 70 of the post bracket 22. The lower nut 80 secures the fin assembly 18 and the auger 14 together while an upper nut 88 and washer 92 locks the post bracket 22 to the cap plate. Also shown are examples of fasteners for connecting the post 2 to the post bracket 22 such as coupling nut 66 with opposing cap screws 86 and the option of using either a flat washer 84 or a decorative flange nut style washer. Typically, a user would not mix and match fasteners as shown here but would choose one or the other.

Referring to FIGS. 15-17 are depicted an embodiment of a through bolt fastening system comprising a coupling nut 66, a flat washer 84 and a cap screw 86. This is one possible way to secure the post withing the post bracket 22. Alternatively, a flange nut with an unthreaded through hole can be used with the cap nut 86 for a more ornate presentation.

Referring to FIGS. 18-22, there is shown another embodiment of a post bracket of the present invention, numbered as post bracket 122. Post bracket 122 is an adjustable post bracket having two halves 101 that slideably mate with each other to define the adjustable post bracket 122 that can accommodate different sized square posts. For example, post bracket 122 may be sized and configured to enable installation of 2" or a 2.5" square metal post, which encompasses many popular metal fence posts for common applications. The halves 101 are almost identical in that each includes a side wall 102, a back wall 103 that extends upward to define upwardly standing walls or panels 160, and an opposite side wall 104 that includes an inward planar horizontal panel that defines a first horizontal planar surface 168. The halves 101 each have a horizontal panel 105 that defines a second planar surface 170 that is lower than the first surface 168. The difference between the two halves 101 is that the horizontal panel 105*a* of one of the halves 101 is slightly higher than the horizontal panel 105*b* of the other of the halves 101 so that panel 105*a* can slide on top of panel 105*b* as the two halves 101 are mated. The panels 105 of both halves 101 include an elongate aperture 176 in the surface 170 that is adapted to receive the threaded portion 36 of the auger rod 14 and provides some travel of the threaded portion therein. Side panels 102 may include holes 107 to receive and guide fasteners 108. In assembly, the two halves 101 are made to face each other and are mated such that the side wall 102 of one of the halves 101 overlaps the opposite side panel 104 on the other of the halves 101, and panel 105*a* overlaps panel 105*b* as the two halves 101 are brought together. Once a desired distance is achieved between the upward panels 160, depending on the post size, the two halves 101 are secured to each other by fasteners 108 that are driven through the mated side panel pair 102-104 on each side. The halves 101 may be constructed out of a sheet metal or plastic, and the fasteners 108 may be self-tapping screws that can penetrate through the side walls 102-104 as they are driven into the material. With the two halves being secured to each other, they define the post bracket 122 in which the first horizontal planar surfaces 168 on each halve 101 together define a first horizontal surface upon which the bottom edge of the post 2 abuts. The two upstanding panels 160 are secured to the post 2 in a similar manner as the panels 60 of post bracket 22 described above. The lower horizontal panels 105 together define the second horizontal surface 170 with the elongate aperture 176 therein.

In use the assembled post bracket 122 functions and is in installed in a similar manner to post bracket 22 as being part of the post anchor device 10 of the present invention. Thus, the assembled post bracket 122 has two opposing and upwardly standing walls or panels 160 rising from a first horizontal planar surface 168 upon which the bottom end of post 2 rests, and a second planar surface 170 parallel to the first surface 168 but lower such that a cavity 172 is defined when the post 2 is fully seated on the first surface 168. The cavity 172 accommodates the terminus 38 of the auger rod 14 in the fully assembled post anchor device 10 so that it does not interfere with the seating of the post 2 into the post bracket 122. The opposing vertical side panels 160 include a plurality of holes 162 to receive fasteners for securing the panels to the post. In some embodiments, the panels 160 may include the pair of holes 64 as shown on post bracket 22 in mirror opposition and sized to one another such that a continuous fastener such as a barrel bolt or coupling nut 66 may pass through said holes 64 and through the post 2 to secure the post bracket panels 60 to the post 2. The cavity 172 has its lower limits defined by the lower planar surface 170 which is more easily depicted in FIG. 14. The elongate aperture 176 in the surface 170 is adapted to receive the threaded portion 36 of the auger rod 14 and provides some travel of the threaded portion therein. The travel of the threaded portion 36 within the elongate aperture 176 enables a degree of movement of the post bracket 122 relative the auger rod 14 (which is secured to the soil in use of the device) to accommodate imperfect linear alignment of a plurality of post anchoring support devices by enabling each post bracket 122 to be moved laterally in relation to the linear direction of an intended common post or fence line.

The following describes the characteristics of the device and the methods of employing it. The methods of employing either post anchor devices 10*a*, with the four-fin assembly 18, or post anchor device 10*b*, with the two-fin assembly 18, do not vary but the different assemblies are optimized for different performance characteristics. For example, the four-fin assembly may be used for both fence posts within a line of fencing as well as for standalone posts that might support signs or light fixtures. The multiple fin configuration allows posts connected to it to withstand lateral forces for all directions. In contrast, the two fin assembly 18 is optimized only for fence applications where it can best resist lateral forces perpendicular to the fence panels. Fences provide racking or sheer resistance along the plane of the fence because of the series of posts and panels aligned directly behind each other. Therefore, the more substantial multi fletching configuration would not be necessary though it would still be suitable for a fence as well.

Installing a post with the post anchor device 10 of the present invention starts by using an impact wrench with an appropriately size socket to match the drive head or terminus 38 of the auger rod 14. A person skilled in the art will note that other means of driving the auger into the soil are possible as well such as using any kind of suitably shaped aperture attached to a lever arm whereby torque can be generated. Therefore, it is just as possible to drive the auger into the soil by means of manpower as it is to use an impact wrench powered by electricity or pneumatic force.

Preferably, the person installing the post anchor device 10 would remove the top two to three inches of sod (grass) to expose the mineral soil. The exact location of the post would be marked and ideally a corner style level bracket with an elastic band can be fitted against the auger tube to guide the installer while driving the auger into the ground.

This method greatly facilitates obtaining a perfectly perpendicular installation of the auger 14 into the soil.

The auger rod 14 is driven into the soil to the point where the circumferential shoulder 42 is level with or slightly below the elevation of the soil. Preferably the lower threads of the threaded portion 40 are about ½" below the grade. If a rock or obstacle is encountered while driving the auger rod into the soil, it is possible to reverse the auger and move to another location. Installers may also test locations by driving a ½" piece of steel re-bar into the soil to determine if the soil is suitable. Alternatively, bit extender and a 1" drill bit may be used to create a pilot hole in the soil and verify if there are any immobile obstacles. These techniques are not necessary but can be done and a pre-drilled hole can marginally reduce the torque required to drive the auger into place.

Once the auger rod 14 is firmly embedded in the soil to the desired depth, the channel 76 of the fin assembly 18 is aligned over the terminus 38 and the fin assembly 18 is forced down into the soil. The channel 76 of the fin assembly follows the threaded portion 40 of the auger 14. An installer may use a small 31*b* hammer and strike the cap plate in the center and the assembly will be driven into the soil. The terminus 38 will pass through aperture 56 of the cap plate 52. The hammer strikes on the cap plate 52 would then be made in a progressively circular pattern around the terminus 38 until the underside of the cap plate 52 makes full contact with the circumferential shoulder 42. Alternatively, a piece of a 4×4 wood post cut approximately 24" to 36" tall can be modified to efficiently direct the force of hammer strikes against the cap plate 52 without having to consider the terminus 38 passing through the cap plate. This is done by boring a small ¾" diameter hole about 2" deep into the center of the bottom of the 4×4 wood post so that drive head 38 can fit within the cavity. A nut 80 is then secured on the threads of the rod 40 and locks the cap plate 52 against the auger 14 and the fin assembly 24 is then securely integrated with the auger and the soil.

The post bracket 22 or 122 is attached to the cap plate 52 by slipping the threaded portion 40 through the elongated aperture 76 defined in the horizontal planar surface 68 at the bottom of the channel 72. The post bracket 22 or 122 may be moved laterally within the confines of the aperture 76 until a precise horizontal position is achieved. A washer 88 is placed over the threaded portion 40 and a nut 88 is turned tightly to lock the post bracket 22 or 122 into its final position. The ability to adjust the lateral position of the post bracket 22 or 122 relative to the auger rod 14 via the elongate aperture 76 is particularly useful when building a fence with three or more consecutive posts because notwithstanding difficulties driving the auger rods into perfection position, errors in alignment of the auger rods can be compensated for with the lateral adjustment of the post brackets.

A post 2 is then fitted between the two vertical panels 60 and the post is ready to be plumbed for precise vertical orientation. This may be achieved by tightening a clamp around the panels 60 of the post bracket 22 or 122 and gently securing the post 2 such that it can still be moved into precise vertical orientation while a long level is held against the post. Once level is obtained the clamp can be fully secured. An installer can then drive common wood screws through the smaller holes 62 and the post is installed. However, for an even stronger connection a through bolt system may be used. This requires that a ½" hole be bored through the post in alignment with the larger holes 64 and a coupling nut 66 be set inside each bore. A simple connection can be completed by using a flat washer 84 and a common cap screw 86 and driving the cap screws into opposing ends of the coupling nut and tightening them. For a more appealing appearance, the flat washer may be replaced with a suitable flange nut which has an unthreaded through hole that allows passage of the cap screw 86. Very strong connections can be obtained this way.

Referring to FIGS. 24-29, there is shown another embodiment of the present invention comprising the auger rod 14 is as described above, a fin assembly 218 and a post bracket 222. The fin assembly 218 is similar to fin assembly 18 described above except it has a variant of the cap plate such that cap plate 252 includes parallel slots 254 in addition to the hole the hole 256 is provided in the center of the cap plate to accommodate the threaded portion 36 and the terminus 38 of the auger rod 14.

The post bracket 222 similar to post bracket 22 described above except the base 230 that defines the surface 270 is planar and includes holes 232 aligned linearly around the periphery of the base 230. Further, the first surface that supports the post is provided by the upper edges of vertical side walls 268. The holes 232 are positioned to align with the slots 254 on the cap plate 252 when the fin assembly 218 and the post bracket 222 are mounted on the auger rod 14. The elongate aperture 276 is analogous to the elongate aperture 76 of post bracket 22.

Carriage bolts 238 may be provided that pass through one or more slots 254 and aligned hole 232 and secured by nuts 239 to provide additional clamping force between the base 230 of the post bracket 222 and the cap plate 252 of the fin assembly 218, thereby more securely fastening the post bracket to the fin assembly. The slots 254 are parallel to the elongate aperture 276 so that the carriage bolts 238 may travel within the slots in conjunction with the threaded portion 36 of the auger rod 14 traveling along the elongate aperture 276 to enable lateral positioning of the post bracket 222 relative to the fin assembly 218. Once positioned, nut 88 may be tightened onto the threaded portion 36, and the nuts 239 may be tightened onto the carriage bolts 238. The slots 254 are of sufficient width so as to conform closely with the square neck of the carriage bolt 238. This stops the bolt from rotating as nuts are threaded to it. This also allows for bolts to slide laterally along the plate thereby providing a nut and bolt fastening means in addition to the nut over the threaded drive rod. This secondary and optional nut and bolt fastening means provides a greater degree of resistance to moment loads generated when a post or fence panel is under lateral load.

To further assist in the application of the nut and bolt fastening means, a speed washer 241 is used with each carriage bolt 238 so that the bolt can be fitted into the slot, the speed washer is threaded onto the bolt until the washer makes close contact with the cap plate thus retaining the bolt with the cap plate. The fin assembly can be driven into the ground and while the bolt remain in the slots as the fin and cap plate are gradually forced closer to the grade of the soil. Without this feature the bolts would fall out from the plate during the drive phase into the ground. It would be very difficult to insert the bolts through the cap plate via the underside of the cap plate once the assembly is fully anchored in the ground. The fins in the fin assembly 218 may be provided with clearance openings 246 that allow the head of the carriage bolt 238 to pass freely through the vertical plane of the fin panels as the post bracket is adjusted to its final position.

Additionally, post bracket 222 may be secured to the embodiment of the cap plate of fin assembly 18 that does not have slots. In such a case, self-drilling screws could be secured through holes 232 directly into the cap plate 52 for additional security, thereby providing additional moment load resistance.

Lateral resistance within the soil is important for the post anchoring device to deliver the performance characteristics that users are looking for. There are numerous benefits to the present invention that would be apparent to those skilled in the art. One benefit of the present invention over common spike devices is that a spike is long and must be hammered in 30" to 36" or longer. Whereas the present device is designed for installation by use of a hand-held impact wrench which substantially lessens the effort required to install it. The length of the fin assembly is typically no more than 10"-12" long and this is easily impaled into the soil compared with 36" long spike devices. This eliminates much labor, and the resulting lateral resistance exceeds that of spike systems because the widest part of the assembly is located in the upper 12" of the soil while the helical blades are buried deeply into the soil providing immense tension resistance when the fin is subjected to lateral loads. This is compared to the fine point at the tip of a spiked device which does not provide the same kind of tension resistance at depth in the soil when the spike is loaded laterally.

The simplicity of the lateral adjustment of the post bracket relative to the auger odd makes it a very good solution for accurately locating and anchoring posts for fences where numerous posts must be precisely in line with one another. It also is well suited for structures like arbors, pergolas, and pavilions which have multiple posts requiring accurate locations. The present device can be paired easily with premanufactured gazebos, pergolas and pavilions given that the range of motion each post can be adjusted despite usual obstacles found in some soil conditions. This further increases its range of usefulness.

Post brackets of the present invention may be configured to accommodate round posts as would be apparent to persons parent skilled in the art, such as for example by providing curved vertical panels.

The present invention also allows for temporary installation of posts because they can be easily removed by dismantling the post form the post bracket and reversing the auger from the soil. In contrast, the prior art spike devices require immense leverage to be withdrawn from soil.

Users skilled in the art will also appreciate that because the fin assembly allows the threaded portion of auger rod to pass through and rotate within the channel, large holes in the soil are not required to be excavated in advance of driving the auger into the ground. Other side auger devices in the prior art on which the fins are permanently connected to the auger portion require excavation for each hole to a depth sufficient to accommodate the fins as such device is rotationally driven into the soil. Back filled soil is then put back into the hole, in between the fins, tamped, and left to settle. Much time is required for the back fill around the fin to settle. It is this unsettled zone of soil that will bear the greatest brunt against the fins during lateral loading. Hence, the post-anchor device of the present invention avoids this weakness inherent in the prior art devices since the soil into which the fin assembly is driven his minimally disturbed, resulting in immediate maximum resistance of the soil to lateral movement of the fins.

The present device offers an improved means of installing posts into the ground; can provide improved lateral resistance and easily adjust horizontally and vertically for structures like fences, arbors, pergolas, gazebos and the like.

Although the preferred embodiments of the device and method have been shown in the attached drawings and detailed description, it is understood that the invention is not limited to the embodiments disclosed, but is capable of other modifications without departing from the spirit of the invention set forth and defined in the following claims.

What is claimed is:

1. A post anchor device for anchoring an end of a support post or beam of a deck or similar construction to the ground, the post anchor device comprising:

an auger rod having a shaft with a lower portion and an upper portion, the upper portion having an externally threaded portion and terminating in an upper end configured to being engaged and rotated by a drive tool for rotating the shaft about its longitudinal axis, the lower portion having a bottom end for insertion into the ground and at least one helical blade on the shaft above the bottom end for boring the auger rod into the ground as the shaft is rotated about the longitudinal axis;

at least one fin removably connected to the upper portion and being longitudinally aligned with the shaft of the auger rod, and includes a tubular portion that is receivable onto the upper portion of the shaft;

a post bracket that is securable to the post or beam and having a base with a hole to receive the externally threaded portion of the shaft to enable the post bracket to be removably connected to the external threaded portion by a complementary nut or an internal threaded member, thereby securing the post bracket to the auger rod;

the at least one fin further comprises a cap plate perpendicular to the tubular portion to provide a platform to support the post bracket, the cap plate includes at least one elongate slot;

the base of the post bracket includes at least one secondary hole that may be placed in vertical alignment with the at least one elongate slot with the post bracket positioned on the cap plate; and a secondary threaded fastener passed through the at least one elongate slot and the aligned secondary hole to provide additional securing force between the post bracket and the at least one fin thereby increasing the resistance to lateral movement of the post bracket relative to the at least one fin.

2. The post anchor device as claimed in claim 1 wherein the at least one fin comprises a plurality of fins radiating from the tubular portion.

3. The post anchor device as claimed in claim 1 wherein the at least one fin comprises a fin assembly having the tubular portion and including fins longitudinally aligned with the shaft of the auger rod.

4. The post anchor device as claimed in claim 3 wherein the fin assembly comprises two identical fin panels, each fin panel including a central portion defining a channel and a fin portion defining one or more of the fins, the fin panels being joined together in a manner that the central portions of the fin panels define the tubular portion of the fin assembly.

5. The post anchor device as claimed in claim 3 wherein the fin assembly comprises two identical unitary fin panels, each fin panel including a central portion defining a channel and a fin portion defining one or more of the fins, the fin panels oriented to face and abut each other in a manner that the central portions of the fin panels define the tubular portion of the fin assembly and the fin panels being joined together by welds at points of abutment.

6. The post anchor device as claimed in claim 1 wherein the hole in the base is an elongate aperture that enables lateral positioning of the threaded portion within the elongate aperture thereby permitting adjustment of the post bracket relative to the at least one fin prior to tightening of the complementary nut or an internal threaded member.

7. The post anchor device as claimed in claim 1 wherein the post bracket further comprises a support portion defining a support surface for abutting the post or beam, the support surface being located vertically on the post bracket to be above the upper end of the shaft with the external threaded portion received in the post bracket, at least two vertical planar walls extending above the support surface to receive fasteners to secure the walls to the post or beam.

* * * * *